United States Patent [19]

Fujita

[11] Patent Number: 4,860,696

[45] Date of Patent: Aug. 29, 1989

[54] APPARATUS FOR CONTROLLING BOILER SYSTEM

[75] Inventor: Tadao Fujita, Tokyo, Japan

[73] Assignee: Ebara Corporation, Tokyo, Japan

[21] Appl. No.: 243,552

[22] PCT Filed: Dec. 8, 1987

[86] PCT No.: PCT/JP87/00949

§ 371 Date: Oct. 3, 1988

§ 102(e) Date: Oct. 3, 1988

[30] Foreign Application Priority Data

Dec. 8, 1986 [JP] Japan ..... 61-291954

[51] Int. Cl.[4] ..... F22B 37/42

[52] U.S. Cl. ..... 122/448 B; 60/667; 60/676

[58] Field of Search ..... 122/448, 1 R; 60/667, 60/676

[56] References Cited

U.S. PATENT DOCUMENTS

| | | | |
|---|---|---|---|
| 3,387,589 | 6/1968 | Chan et al. . | |
| 4,418,541 | 12/1983 | Russell | 122/448 B X |
| 4,534,321 | 8/1985 | Rydborn | 122/448 B |
| 4,598,668 | 7/1986 | Bader | 122/448 B X |

FOREIGN PATENT DOCUMENTS

| | | |
|---|---|---|
| 48-50701 | of 0000 | Japan . |
| 46-43055 | 12/1971 | Japan . |
| 54-81401 | 6/1979 | Japan . |
| 55-77604 | 6/1980 | Japan . |
| 56-113902 | 9/1981 | Japan . |

OTHER PUBLICATIONS

"Instrumentation and Control of Boiler", Japan Boiler Association, Oct. 25, 1974, pp. 314–319.

*Primary Examiner*—Edward G. Favors

*Attorney, Agent, or Firm*—Armstrong, Nikaido, Marmelstein, Kubovcik & Murray

[57] ABSTRACT

The output vapor pressure of a boiler system is controlled by selectively starting or stopping a plurality of boiler units (#1 to #4) shiftable between a high combustion state to a low combustion state in accordance with the output vapor pressure of the entire system or by shifting the boiler units between the high and low combustion states. At least two boiler units among the plurality of boiler units are selected as adjustment units in accordance with the output vapor pressure of the entire system. Each of the adjustment units is forced to shift alternately between the high and low combustion states in accordance with the output vapor pressure while continuously holding the adjustment units in the operating state.

1 Claim, 5 Drawing Sheets

COMBUSTION UNIT NUMBER DECREASE REQUEST SIGNAL Bd
COMBUSTION UNIT NUMBER INCREASE REQUEST SIGNAL Bi
LOW COMBUSTION STATE REQUEST SIGNAL Bℓ
HIGH COMBUSTION STATE REQUEST SIGNAL Bh
16d
15d
8.0kg/cm2
16c
15c
7.8kg/cm2
16b
15b
7.4kg/cm2
16a
15a
7.2kg/cm2
RESISTANCE-VOLTAGE CONVERTING CIRCUIT
13
14
12
PRESSURE ADJUSTER

APPARATUS FOR CONTROLLING BOILER SYSTEM

TECHNICAL FIELD

The present invention generally relates to a heating system comprising a plurality of heating units, and more particularly, to the heating system equipped with a plurality of heating units shiftable from a high outputting state to a low outputting state and vice versa during its operation.

As an example of such a heating system, there is typically a boiler system comprising a plurality of boiler units. Hence, the present invention deals with the boiler system provided with a plurality of boiler units shiftable from a high combustion state to a low combustion state and vice versa during its operation.

BACKGROUND OF THE ART

The boiler system formed of a plurality of boilers each having a relatively small capacity exhibits a variety of advantages as compared with a system which employs a single boiler of a large capacity. To be specific, there is generally almost no chance for the large capacity boiler to be operated under a condition of the maximum output. It is therefore quite rare that its potential evaporation capability is effectively utilized. In sharp contrast with this, the boiler system based on combinations of small capacity boilers is arranged in such a way that in the great majority of cases the individual boilers function at their maximum output, and it follows that the potential capabilities thereof are efficiently exhibited. This is the most of the advantages mentioned above.

In general, the boiler is inevitably required to go through the preparatory stage which is commonly referred to as "prepurge" (ventilating or scavenging) and a subsequent low output state during a process originating from the halting state to a high output state (high combustion state), irrespective of the magnitude of capacity thereof. The preparatory stage causes not a little delay in time when starting the boilers. For this reason, it is desirable to remain the boilers which have once started in the continuous combustion state to the greatest possible degree, thereby causing the time lag at the starting time to be minimized, and making the boilers follow fluctuations in load (the amount of evaporation required per unit time) on the system quickly and smoothly.

For the purpose of satisfying the above-mentioned requirements, a wide variety of systems for controlling the boiler system have heretofore been proposed. Among conventional control systems, the arrangement of a well-known control system is such that the respective boiler units which are combined to constitute a boiler system are stepwise controlled at, e.g., two stages—i.e., these boiler units are shifted alternately between the high and low output states, or, that the boiler units are consecutively controlled to vary the outputs thereof with no interruption between the predetermined maximum and minimum values. A typical system in the former case is disclosed in, e.g., Japanese Patent Public Disclosure No. 81401/79, while a system in the latter case is disclosed in, e.g., U.S. Pat. No. 3,387,589.

In all these known systems for controlling the boiler system, a specific boiler unit among the plurality of boiler units, viz., the boiler unit which starts lastly, is operated to shift alternately from the low output state to the high output state in accordance with fluctuations in load, such a boiler unit is controlled to be brought into the halting state (a stepwise control system), or the boiler unit which starts lastly is controlled to shift alternately from the operating state to the halting state between the maximum and minimum output values (a continuous control system). In either case, the specific boiler unit is forced to frequently start and stop. As discussed above, the starting from the halting state always involves the above-mentioned prepurge and subsequent low output state. This is one of the factors which outstandingly degrade a response of the boiler system to the fluctuations in load.

DISCLOSURE OF INVENTION

Accordingly, it is an object of the present invention which eliminates the above-described disadvantageous factors to provide an apparatus for controlling a boiler system wherein at least two boiler units are constantly secured as adjustment units in a stationary state of the boiler system, and wherein these two or more boiler units are each controlled to properly shift from a high output state to a low output state and vice versa, viz., between a high combustion state and a low combustion state in accordance with variations in the output vapor pressure, i.e., variations in the entire output of the boiler system, by constantly maintaining the adjustment units to be in the combustion state, thereby causing the output of the entire boiler system to smoothly converge in a desired range without repeatedly stopping and starting each boiler unit.

To this end, the present invention is intended to provide an apparatus for controlling a boiler system, comprising: a plurality of boiler units 10 connected in common to a steam header 11 and each shiftable between a halting state and an operating state in response to each of a combustion starting signal BI and a combustion stopping signal BD, and further shiftable, in the operating state, between a high combustion state and a low combustion state in response to each of a high combustion state selecting signal BH and a low combustion state selecting signal BL; a pressure adjuster 12 connected to the steam header 11 for outputting a vapor pressure signal P indicating the vapor pressure in the header; and a control unit 13 for controlling each of the plurality of boiler units in the three states in response to the vapor pressure signal P transmitted from the pressure adjuster 12. This control unit 13 includes: combustion unit number increase request signal generating means **15*a* for outputting a combustion unit number increase request signal Bi by detecting the fact that the vapor pressure indicated by the vapor pressure signal P is equal to or smaller than a first critical value; high combustion state request signal generating means 15*b* for outputting a high combustion state request signal Bh by detecting the fact that the vapor pressure indicated by the vapor pressure signal P is equal to or smaller than a second critical value which is greater than the first critical value; low combustion state request signal generating means 15*c* for outputting a low combustion state request signal Bl by detecting the fact that the vapor pressure indicated by the vapor pressure signal P is equal to or larger than a third critical value which is greater than the second critical value; combustion unit number decrease request signal generating means 15*d* for outputting a combustion unit number decrease request signal Bd by detecting the fact that the vapor pressure indicated by the vapor pressure signal P is equal to or larger than a fourth critical value which is greater than the third critical value; combustion unit number setting means 17 for sequentially supplying each of the plurality of boiler units 10 with the combustion starting signal BI in response to the combustion unit number increase request signal Bi according to the order of starting the boiler units every time a predetermined period passes and for sequentially supplying each of the plurality of boiler units with the combustion stopping signal BD in response to the combustion unit number decrease request signal Bd in the order reverse to the starting order every time a predetermined period passes; combustion state selecting means 18 for sequentially supplying each of the plurality of boiler units 10 with the high combustion state selecting signal BH in response to the high combustion state request signal Bh in the order of starting the boiler units every time a predetermined period passes and for sequentially supplying each of the plurality of boiler units 10 with the low combustion state selecting signal BL in response to the low combustion state request signal Bl in the order reverse to the starting order every time a predetermined period passes; adjustment unit number setting means 21 for outputting an adjustment unit number increase signal Bp by deciding that the number of boiler units which are operating in the low combustion state is smaller than the number of adjustment units on the basis of the combustion starting signal BI supplied from the combustion unit number setting means 17 to each of the plurality of boiler units 10, the low combustion state selecting signal BL supplied from the combustion state selecting means 18 to each of the plurality of boiler units 10 and an adjustment unit number setting signal indicating the number of adjustment units; and low combustion state request signal supplying means 19 for allowing the low combustion state request signal Bl to be supplied to the combustion state selecting means 18** in response to the adjustment unit number increase signal Bp.

In accordance with the present invention, at least two boiler units may be constantly kept in the combustion state in the stationary state of the boiler system, and these two or more boiler units may be each controlled to shift between the high and low combustion states in accordance with variations in the output of the entire boiler system, viz., variations in the output vapor pressure, thereby minimizing the frequency at which the respective boiler units are repeatedly stopped and started. As a result, it is possible to obtain an effect of permitting the output of the entire boiler system to smoothly converge in a desired range. Besides, the larger the number of adjustment units is, the more the number of boiler units which shift from the high combustion state to the low combustion state and vice versa increases. Hence, it is also possible to obtain an advantage of being able to cope with the variations in load with no precharge sequent to the starting process, that is, without increasing the number of combustion units when shifting to a higher load.

In an embodiment of the present invention, if a sharp fluctuation in the vapor pressure takes place a drop or a rise in the pressure within the boiler system is restrained while sequentially shifting the adjustment units from the low combustion state to the high combustion state and vice versa at 3-second intervals. Nevertheless, if the pressure is further increased or decreased to enter a control region A or E, the number of boiler units in combustion state is gradually increased or reduced. The larger the number of set adjustment units is, the larger the number of boiler units shifting alternately between the low combustion state and the high combustion state with the delay of 3 sec becomes. It is therefore possible to effectively cope with fluctuations in load with no increment in the number of boiler units in combustion state when, e.g., shifting to a higher load.

BEST MODE FOR CARRYING OUT THE INVENTION

An embodiment when an apparatus for controlling a heating system according to the present invention is applied to the control of output of a boiler system having a plurality of boiler units will hereinafter be described with reference to the accompanying drawings. It is to be noted that the boiler system to which the controlling apparatus according to the present invention can be applied may include any type of and any number of boiler units. In the embodiment that will be described below, however, for convenience of description, the boiler system is constituted by connecting four units of steam boilers.

Figure 1:
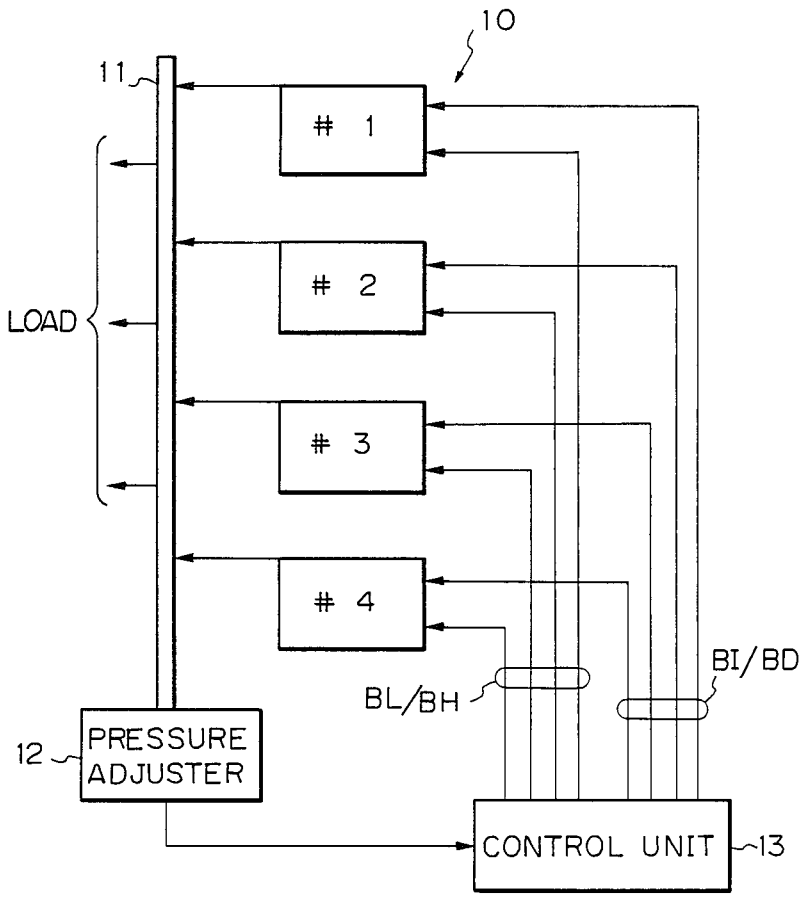
FIG. 1 is a schematic diagram schematically illustrating a boiler system to which a boiler controlling apparatus according to the present invention is applicable.

FIG. 1 schematically illustrates a boiler system 10 to which the controlling apparatus according to the present invention may be applied. The boiler system 10 includes, as explained earlier, four steam boiler units (hereinafter simply referred to as boiler units). These four boiler units are each marked with the symbols #1, #2, #3 and #4 in accordance with the order of starting these boiler units. Outputs of the boiler units #1 to #4 are connected in common to a steam header 11 and are further led therethrough to a load device (not shown). The steam header 11 is provided with a pressure adjuster 12 by which the vapor pressure in the steam header is always adjusted to a substantially predetermined value. The pressure adjuster having such a function is well known and the detailed description is therefore omitted herein.

The boiler unit controlling apparatus according to the present invention selectively controls the boiler units #1 to #4, that are combined to form the boiler system 10, by use of a control unit 13 employing a microcomputer on the basis of the vapor pressure in the steam header 11 which is detected by a variable resistor incorporated into the pressure adjuster 12.

Figures 2, 2A, 2B:
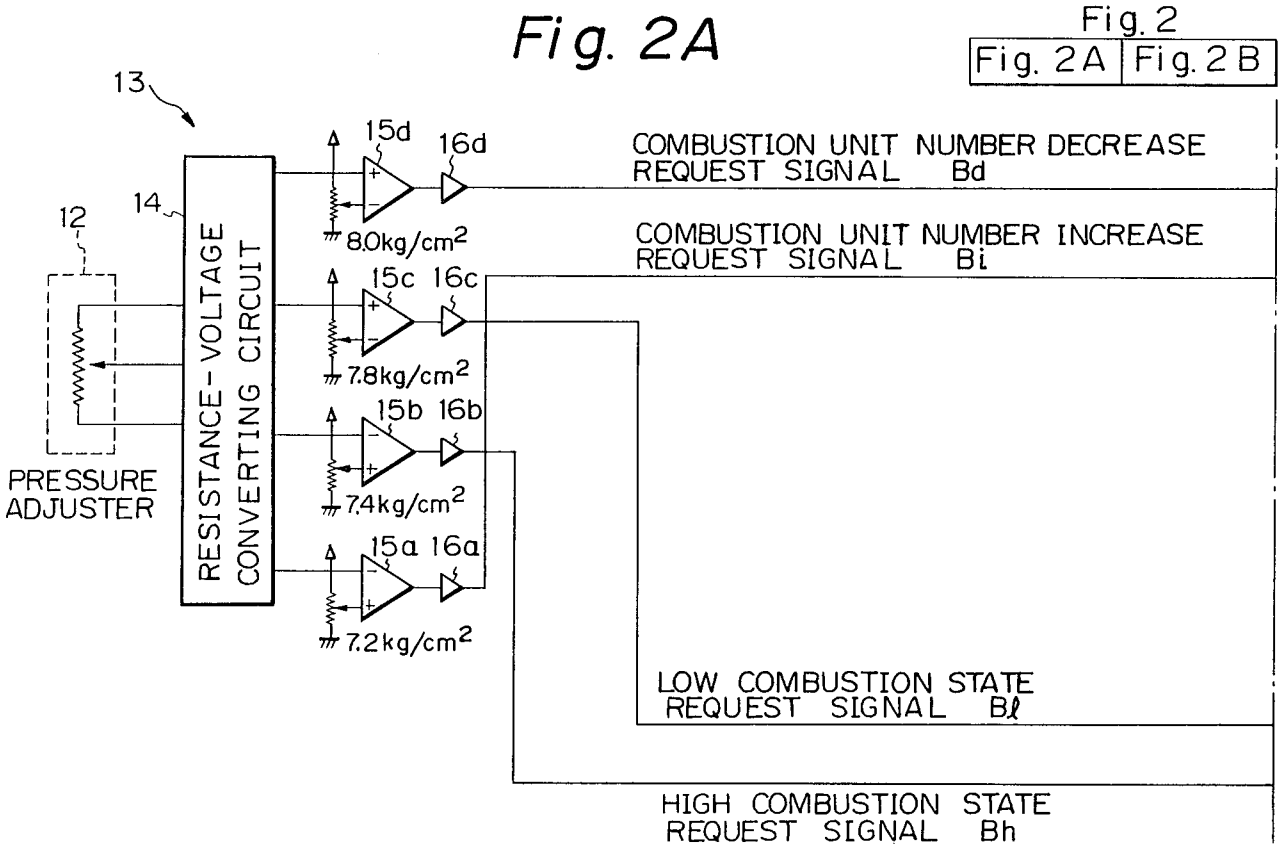
FIGs. 2A and 2B are a block diagram conceptually showing an example of constitution of a hardware for executing algorithm of the controlling apparatus according to the present invention, as a concrete example of constitution of the controlling apparatus in the system depicted in FIG. 1.
Figure 2B:
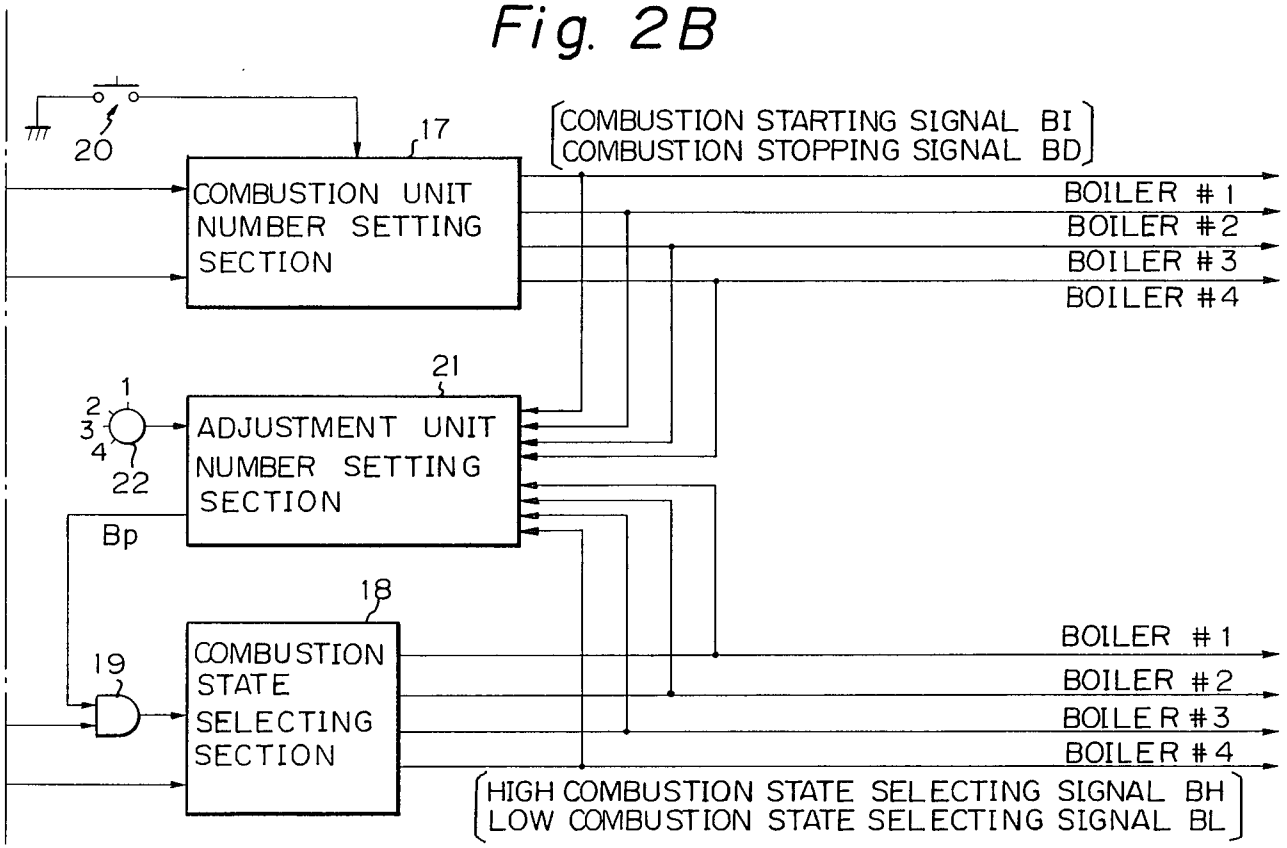

FIG. 2 conceptually shows a hardware constitution for executing algorithm of the controlling apparatus, as a concrete example of constitution of the above-mentioned control unit 13. According to the illustrated hardware constitution, the resistance value of the variable resistor incorporated into the pressure adjuster 12 is converted into the voltage value by means of a resistance-voltage converting circuit 14, which outputs the voltage proportional or corresponding to the vapor pressure in the steam header 11 which is detected by the pressure adjuster 12. The output voltage of the resistance-voltage converting circuit 14 is input to a voltage comparing circuit 15 comprising a plurality of comparators, i.e., four comparators 15*a* through 15*d* in this embodiment. In each of these four comparators 15*a* through 15*d*, the reference voltage value corresponding to the critical value of the predetermined vapor pressure in the steam header 12 that is detected by the pressure adjuster 12 is set. When the voltage input to each comparator exceeds the reference voltage value, the voltage changing to a high or low level is output. In this embodiment, it is assumed that, for instance, the reference voltage value corresponding to the first critical value 7.2 kg/cm$^2$ is set in the first comparator 15*a*; the reference voltage value corresponding to the second critical value 7.4 kg/cm$^2$ is set in the second comparator 15*b*; the reference voltage value corresponding to the third critical value 7.8 kg/cm$^2$ is set in the third comparator 15*c*; and the reference voltage value corresponding to the fourth critical value 8.0 kg/cm$^2$ is set in the fourth comparator 15*d*. Outputs from the comparators 15*a* to 15*d* are input through, e.g., buffers 16*a* to 16*d* to a processor of a microcomputer where these signals are processed.

More specifically, the output from the first comparator 15*a* is input as a combustion unit number increase request signal Bi through the buffer 16*a* to a combustion unit number setting section 17, while the output from the fourth comparator 15*d* is input as a combustion unit number decrease request signal Bd through the buffer 16*d* to the same setting section 17. Furthermore, the output from the second comparator 15*b* is input as a high combustion state request signal Bh through the buffer 16*b* to a combustion state selecting section 18, and the output from the third comparator 15*c* is input as a low combustion state request signal Bl through the buffer 16*c* to one input of an AND gate 19. It is noted that these output signals Bi, Bd, Bh and Bl are assumed to be active-high signals and become active at the high level when the input voltage of the comparators 15*a* and 15*b* is equal to or smaller than the respective reference voltage and when the input voltage of the comparators 15*c* and 15*d* is equal to or greater than the respective reference voltage.

When a starting switch 20 is turned ON, the combustion unit number setting section 17 is activated, and a combustion starting signal BI at the high level or a combustion stopping signal BD at the low level is output to be selectively supplied to the boiler units #1 to #4 in response to the input signal Bi or Bd. The output signal BI or BD from the combustion unit number setting section 17 is further input to an adjustment unit number setting section 21. During the period for which the combustion unit number increase request signal Bi is present in the input, the combustion unit number setting section 17 sequentially outputs the combustion starting signals BI at the high level to the boiler units at predetermined intervals in accordance with the order of starting the boiler units, viz., in the order #1→#2→#3→#4. The time interval at which the combustion starting signal BI at the high level is sequentially supplied to the respective boiler units is preferably around 10 sec, taking into consideration some time lag produced when the respective boiler units are activated from their halting state and reach the high combustion state. Where the boiler units each shift from the halting state to the combustion state in response to the combustion starting signal BI transmitted from the combustion unit number setting section 17, it is presumed that the boiler units shift unconditionally to the high combustion state. Prior to the shifting of the boiler units from the halting state to the high combustion state, there are more or less a delay in time and a low combustion state period subsequent thereto.

On the other hand, during the combustion unit number decrease request signal Bd exists, the combustion stopping signal BD at the low level is sequentially output to be supplied to the boiler units at predetermined intervals of, for example, 4 sec in the order reverse to the boiler unit starting order, i.e., in the order #4→#3→#2→#1.

The adjustment unit number setting section 21 and the combustion state selecting section 18 cooperate to select, among the boiler units that are in the combustion state, boiler units the number of which is set by an adjustment unit number setting switch 22. The selected boiler units are designated as adjustment units. The outputs of the section 21 is input to the other input of the AND gate 19. The logical AND output of the AND gate 19 is input to the combustion state selecting section 18. The combustion state selecting section 18 selectively outputs a high combustion state selecting signal BH at the high level or a low combustion state selecting signal BL at the low level to supply these signals to the boiler units #1 to #4 in response to the logical AND output and the high combustion state request signal Bh transmitted from the second comparator 15*b*. The output signal BH or BL from the combustion state selecting section 18 is also input to the adjustment unit number setting section 21.

The next description will now be focused on the role of the adjustment units in the controlling apparatus according to the present invention. The adjustment units in the present controlling apparatus are boiler units controlled to shift alternately between the low combustion state and the high combustion state in the stationary state in order to absorb fluctuations in load. The number of adjustment units can be set arbitrarily, i.e., in a programable manner by the adjustment unit number setting switch 22. In this embodiment, it is supposed that the number of adjustment unit set by the adjustment unit number setting switch 22 is two, and that the two boiler units started lastly among the boiler units in combustion state are selected and designated as the adjustment units. During all the boiler units #1 to #4 of the boiler system 10 in this embodiment are in combustion state, the two boiler units #4 and #3 started lastly among those boiler units are designated as the adjustment units by the adjustment unit number setting section 21. On the other hand, during the boiler units #1 to #3 are in combustion state, the two boiler units #3 and #2 started lastly among those boiler units are likewise designated as the adjustment units by the number setting section 21. Sequentially output to the thus designated adjustment units are the low combustion state selecting signal BL at the low level at predetermined intervals of, e.g., 3 sec in the order reverse to the starting order—viz., in the order #4→#3 or #3→#2 or #2→#1—during the period for which the vapor pressure is rising and the high level signal is present in the output of the AND gate 19. During the period for which the vapor pressure is falling and the high combustion state request signal Bh appears, the high combustion state selecting signal BH at the high level is sequentially output to be supplied to the adjustment units at the time concerned at predetermined intervals of, for instance, 3 sec in the starting order of #1→#2 or #2→#3 or #3→#4.

The adjustment unit number setting switch 22 comprises, for example, a digital potentiometer or the like and is arranged to output a voltage signal proportional to the number of adjustment units set. The adjustment unit number setting section 21 receives, as input signals, a setting signal from the adjustment unit number setting switch 22 and output signals from the combustion unit number setting section 17 and from the combustion state selecting section 18, and compares the number of boiler units which receive, as the input signal from the combustion unit number setting section 17, the combustion starting signal BI at the high level and, as the input signal from the combustion state selecting section 18, the low combustion state selecting signal BL at the low level, with the number of boiler units which is indicated by the output signal from the adjustment unit number setting switch 22. If the latter, i.e., the number of adjustment units which are set by the switch 22 exceeds the former, viz., the number of boiler units that are being controlled to work in the low combustion state, the section 21 decides that the number of adjustment units is small, and then supplies the adjustment unit number increase signal Bp at the high level to one input of the AND gate 19.

Figure 3:
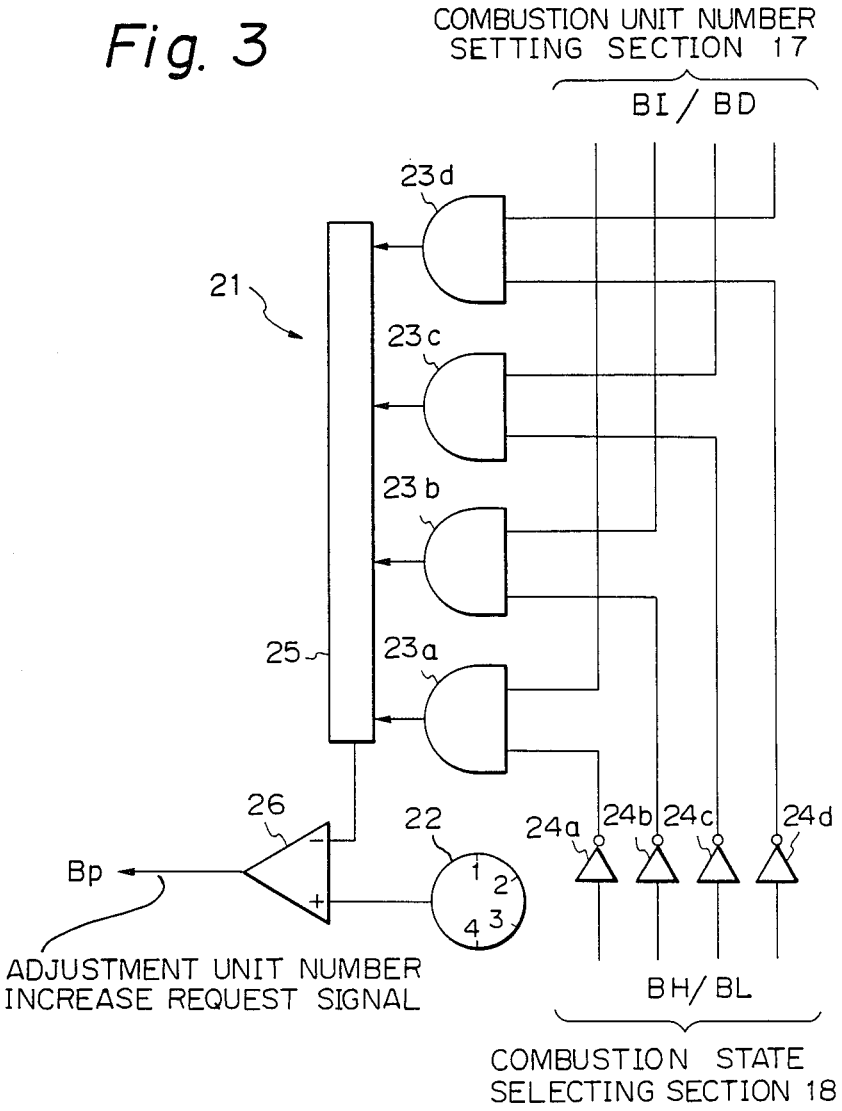
FIG. 3 is a block circuit diagram illustrating one example of constitution of a circuit of an adjustment unit number setting section in the controlling apparatus depicted in FIG. 2.

FIG. 3 illustrates an example of a concrete hardware construction for acquiring a function of the adjustment unit number setting section 21. As illustrated in FIG. 3, the output signals BI or BD transmitted from the combustion unit number setting section 17 to the boiler units #1 to #4 are applied to one input of four AND gates 23*a* to 23*d* separately provided. The output signals BH or BL transmitted from the combustion state selecting section 18 to the boiler units #1 to #4 are applied through separately provided inverters 24*a* to 24*d* to the other input of the AND gates 23*a* to 23*d*. The outputs of the respective AND gates 23*a* to 23*d* are connected via a voltage adding circuit 25 to one input of a comparator 26, while the other input of this comparator 26 is connected to the adjustment unit number setting switch 22. The output signals BI at the high level selectively transmitted from the combustion unit number setting section 17 to the boiler units #1 to #4 are properly input to the AND gates 23*a* to 23*d*. The output signals BL at the low level selectively transmitted from the combustion state selecting section 18 to boiler units #1 to #4 are inverted by the inverters 24*a* through 24*d* and are then adequately input as high level signals to the AND gates 23*a* to 23*d*. The output signals from the AND gates 23*a* to 23*d* are added by the adding circuit 25, which generates a voltage signal indicating the number of boiler units which are controlled to operate in the low combustion state, that is the number of boiler units which receive, as the input signals from the combustion unit number setting section 17, the combustion starting signals BI at the high level and, as the input signals from the combustion state selecting section 18, the low combustion state selecting signals BL at the low level. The output signal from the voltage adding circuit 25 is applied to one input terminal of the comparator 26, and is compared with the output signal applied from the adjustment unit number setting switch 22 to the other input terminal of the comparator 26. If the number of adjustment units set by the adjustment unit number setting switch 22 is larger than the number of boiler units that are being controlled to operate in the low combustion state, the output signal at the high level is output from the comparator 26 as the adjustment unit number increase signals Bp to be applied to one input terminal of the AND gate 19.

The combustion state selecting section 18 receives the adjustment unit number increase signals Bp through the AND gate 19 to effect control so that the number of boiler units supplied with the low combustion state selecting signal BL does not exceed the number of adjustment units set by the adjustment unit number setting switch 22. It is assumed that the boiler unit that is started lastly among the boiler units on combustion at a certain point of time comes to halt combustion, and that transiently only one adjustment unit operates. In such a case, when the vapor pressure rises up to the third critical value 7.8 kg/cm$^2$ and the low combustion state request signal Bl is present in one input terminal of the AND gate 19, the condition of logical product in the AND gate 19 is established by the adjustment unit number increase signals Bp applied from the adjustment unit number setting section 21 to the other input terminal of the AND gate 19; and the boiler unit which is started subsequent to the adjustment unit at that time is designated as a new adjustment unit by the high level output of the AND gate. It follows that this new adjustment unit shifts from the high combustion state to the low combustion state in response to the low combustion state selecting signal BL output from the combustion state selecting section 18.

The combustion state selecting section 18 causes the adjustment unit designated at that time to shift, as described above, from the high combustion state to the low combustion state at intervals of 3 sec in the order reverse to the starting order when the logical AND output from the AND gate 19 assumes high level. However, if the boiler units that are started later among the adjustment units have already been put in the high combustion state, when the output signal is given from the adjustment unit number setting section 21, the boiler unit of the two adjustment units which is started earlier shifts from the high combustion state to the low combustion state.

In such a hardware construction, the boiler system 10 (FIG. 1) is controlled on the basis of a control protocol relative to the following 5-stage control regions.

Control Region A (Operating Unit Number Increase Mode)

When the vapor pressure in the steam header 11 (FIG. 1) is equal to or smaller than the first critical value 7.2 kg/cm$^2$, this region is defined as a pressure control region A. In the control region A, the boiler units are sequentially started one by one in the high combustion state at intervals of 10 sec. In this case, the order of starting the boiler units which shift from the halting state to the high combustion state is #1→#2→#3→#4.

Control Region B (High Combustion State Shifting Mode)

When the vapor pressure is equal to or exceeds the first critical value 7.2 kg/cm$^2$ but is equal to or smaller than the second critical value 7.4 kg/cm$^2$, this region is defined as a pressure control region B. In the control region B, the adjustment units designated at the time concerned shift from the low combustion state to the high combustion state one by one at intervals of 3 sec. In this case, the order of shifting the two adjustment units from the low combustion state to the high combustion state is #1→#2, #2→#3 or #3→#4 in accordance with the starting order. If the vapor pressure is going up, however, every adjustment unit has already been in the high combustion state. Therefore, this mode is executed only when the vapor pressure is decreasing and the adjustment units are all in the low combustion state.

Control Region C (State Holding Mode)

When the vapor pressure is equal to or greater than the second critical value 7.4 kg/cm$^2$ but is equal to or smaller than the third critical value 7.8 kg/cm$^2$, this region is defined as a pressure control region C. In the control region C, all the boiler units hold the state at the time when the vapor pressure rises and exceeds the second critical value, or when the vapor pressure falls and comes to the third critical value or less.

Control Region D (Low Combustion State Shifting Mode)

When the vapor pressure is equal to or greater than the third critical value 7.8 kg/cm$^2$ but is equal to or less than the fourth critical value 8.0 kg/cm$^2$, this is called a control pressure region D. In this control region D, the adjustment units are caused to shift from the high combustion state to the low combustion state one by one at intervals of 3 sec. In this case, the order of shifting the two adjustment units from the high combustion state to the low combustion state is opposite to the starting order, viz., #4→#3, #3→#2 or #2→#1. If the vapor pressure is decreasing, however, every adjustment unit has already been in the low combustion state. For this reason, this mode is executed only when the vapor pressure is rising and the adjustment units are all in the high combustion state.

Control Region E (Combustion Unit Number Decrease Mode)

When the vapor pressure is equal to or exceeds the fourth critical value 8.0 kg/cm$^2$, this is called a pressure control region E. In this control region E, the number of the boiler units is reduced one by one at intervals of 4 sec, and simultaneously the adjustment units are made to shift from the high combustion state to the low combustion state one by one. In this case, the order of halting the boiler units is reverse to the order of starting them, i.e., #4→#3→#2→#1. The order of shifting the adjustment units from the high combustion state to the low combustion state is also opposite to the starting order, viz., #4→#3, #3→#2 or #2→#1.

Figure 4:
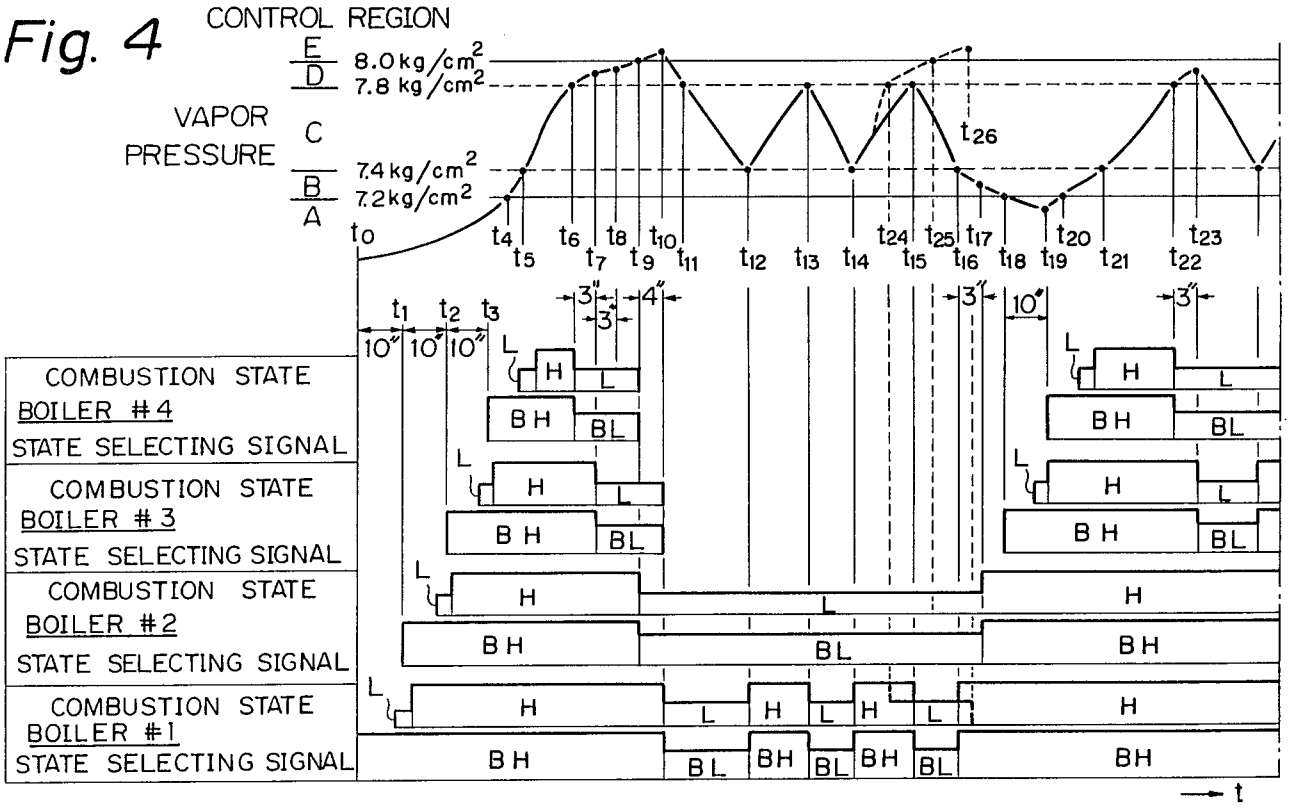
FIG. 4 shows a curved line of vapor pressure when the boiler controlling apparatus according to the present invention is applied to the boiler system depicted in FIG. 1, logical states of control signals selectively supplied to the system at respective points of time on the curved line, and a time chart which shows outputting states of the respective boiler units.

Based on the above-mentioned control protocols, the operation of controlling the boiler system having a construction depicted in FIG. 1 will now be described with reference to FIGS. 2 and 4. In FIG. 4, the symbols BH and BL indicate a high combustion state selecting signal and a low combustion state selecting signal from the combustion state selecting section 18, respectively. The symbols H and L represent actual combustion state of the boiler units—H indicates the high combustion state, while L indicates the low combustion state—during the period for which the high and low combustion state selecting signals BH and BL are output. The low combustion state L of a short period prior to the rising of the high combustion state H of each boiler unit shows a low combustion period which inevitably exists subsequent to the above-described prepurge. In the description that follows, however, it is assumed for the time being that the thermal load on the boiler system is substantially constant. Then, a control operation when the load fluctuates will be explained.

(1) To begin with, when the starting switch 20 depicted in FIG. 2 is turned ON at the time to in FIG. 4, the vapor pressure falls within the above-mentioned pressure control region A. This control region A is, as discussed above, the region where the number of boiler units in combustion state increases one by one at intervals of 10 second. Because the outputs from the comparators **15*a* and 15*b* are held at the high level, the combustion unit number increase request signal Bi and the high combustion state request signal Bh are already output. Accordingly, the combustion starting signal BI from the combustion unit number setting section 17 and the high combustion state selecting signal BH from the combustion state selecting section 18 are output to be supplied to the boiler unit #1. As a result, the boiler unit #1 initiates combustion in the high combustion state H after some prepurge has been effected and the subsequent low combustion state period has passed, whereby the vapor pressure in the header 11 (FIG. 1) of the boiler system rises. At the time t1 after 10 sec has passed since the boiler unit #1 initiated combustion, if the state included in the control region A still continues, the combustion starting signal BI and the high combustion state selecting signal BH are respectively further output from the combustion unit number setting section 17 and the combustion state selecting section 18 and are supplied to the boiler unit #2. The boiler unit #2 likewise initiates combustion in the high combustion state H after some prepurge has been effected and the subsequent low combustion state period has passed. As far as the state in the control region A continues thereafter, the boiler unit #3 and other boiler units which follow sequentially start their combustion at intervals of 10 sec in accordance with the starting order and are then brought into the high combustion state. Thus, a plurality of boiler units have initiated combustion in the high combustion state. In the following description, it is presumed that the boiler units #3 and #4 are started at the time t2 and the time t3, respectively, and that all the boiler units #1 through #4 of the boiler system concerned come into the high combustion state. As explained earlier, if these boiler units #1 to #4 are all in the combustion state, two boiler units #3 and #4** that are started later are designated as the adjustment units.

(2) Since all the boiler units #1 to #4 initiate combustion in the high combustion state in the above-mentioned manner, the vapor pressure in the header immediately rises and comes to the first critical value 7.2 kg/cm$^2$ at, e.g., the time t4 shown in the Figure. The pressure control region then moves from the region A to the region B, viz., to the high combustion state shifting mode. This control region B is in such a mode that the adjustment units shift one by one from the low combustion state to the high combustion state at 3-second intervals. In this embodiment, since the boiler unit #4 of the adjustment units #3 and #4 which is started later in the starting order is in the control region where the unit #4 is forced to shift from the low combustion state L to the high combustion state H, and the output from the comparator 15*b* assumes the high level, the high combustion state request signal Bh is output. The boiler unit #3 has already been in the high combustion state H, and the vapor pressure is increasing. Hence, the respective boiler units #1 to #4 remain as they are, viz., they are held in the high combustion state H.

(3) When the vapor pressure further increases and reaches the second critical value 7.4 kg/cm$^2$ at, e.g., the time t5, the pressure control region shifts from the region B to the region C, i.e., to the state holding mode. In this control region C, the outputs from the comparators 15*a* to 15*d* all assume the low level. Hence, as far as the vapor pressure falls within the range between the second critical value 7.4 kg/cm$^2$ and the third critical value 7.8 kg/cm$^2$, all the boiler units hold their state, viz., the high combustion state H.

(4) Next, when the vapor pressure comes to the third critical value 7.8 kg/cm$^2$ at, e.g., the time t6 shown in the Figure, the control region changes from the region C to the region D, i.e., to the low combustion state shifting mode. This control region D is the region where the adjustment units shift one by one from the high combustion state to the low combustion state at 3-second intervals. In this embodiment, the level of the output from the comparator 15*c* first becomes high, and the low combustion state request signal Bl is then output. Therefore, the low combustion state selecting signal BL is output from the combustion state selecting section 18 and is supplied to the boiler unit #4 of the adjustment units #3 and #4 which is started later in the starting order, whereby this boiler unit #4 moves from the high combustion state H to the low combustion state L. Three seconds after that the adjustment unit #3 that is next in order shifts similarly from the high combustion state H to the low combustion state L at the time t7 in response to the low combustion state selecting signal BL transmitted from the combustion state selecting section 18. However, if the vapor pressure continues to rise and is still higher than the third critical value 7.8 kg/cm$^2$ at the time t8 3 sec after the time t7, since the adjustment units #4 and #3 at the present time are in the low combustion state L, the boiler units #1 to #4 remain as they are.

(5) Thereafter, if the vapor pressure further increases and reaches the fourth critical value 8.0 kg/cm$^2$ at, e.g., the time t9 shown in the Figure, the control region shifts from region D to the region E. This control region E is the region where the number of combustion units is reduced one by one at intervals of 4 sec, and at the same time the adjustment units are forced to shift one by one from the high combustion state to the low combustion state. In this embodiment, the combustion stopping signal BD is output from the combustion unit number setting section 17 to be supplied to the boiler unit #4, and simultaneously the outputs from the comparators 15*d* and 15*c* assume the high level. Then, the low combustion state request signal Bd and the low combustion state request signal Bl are output. The AND gate 19 is simultaneously supplied with the low combustion state request signal Bl and the adjustment unit number increase request signal Bp from the adjustment unit number setting section 22, and then the low combustion state selecting signal BL is output from the combustion state selecting section 18. Thus, the boiler unit #4 that is operating in the low combustion state L halts combustion, and concurrently the designation of adjustment units changes from the boiler units #4 and #3 to another set of boiler units #3 and #2. Since the boiler unit #3 of these adjustment units #3 and #2 which is started later in the starting order has already been brought into the low combustion state L at the time t7, the low combustion state selecting signal BL is output from the combustion state selecting section 18 and is supplied to the boiler unit #2 at the present time t9, making the boiler unit #2 shift to the low combustion state L. It is noted that the combustion stopping signal BD to the boiler unit #4 and the low combustion state selecting signal BL to the boiler unit #2 are output at a time. If the vapor pressure is yet greater than the fourth critical value 8.0 kg/cm$^2$ at the time t10 4 sec after the time t9, the combustion stopping signal BD is output from the combustion unit number setting section 17 to the boiler unit #3 at the time t10, whereby the boiler unit #3 stops combustion. At this time, the level of the output from the comparator 15*c* becomes high, and the low combustion state request signal Bl is output. The thus output low combustion state request signal Bl and the adjustment unit number increase request signal Bp from the adjustment unit number setting section 22 are simultaneously input to the AND gate 19, with the result that the boiler unit #1 is newly designated as the adjustment unit. The designation of adjustment units further changes from the boiler units #3 and #2 to boiler units #2 and #1. Thus, the low combustion state selecting signal BL is output from the combustion state selecting section 18 and is supplied to the boiler unit #1, thereby shifting the boiler unit #1 from the high combustion state H to the low combustion state L. It is to be noted that the combustion stopping signal BD to the boiler unit #3 and the low combustion state selecting signal BL to the boiler unit #1 are simultaneously output.

(6) Since the boiler units #4 and #3 stop combustion in the above-mentioned manner, and the adjustment units #3 and #2 move to the low combustion state L, the vapor pressure immediately drops down. When the vapor pressure becomes smaller than the fourth critical value 8.0 kg/cm$^2$ at, e.g., the time t11 shown in the Figure, the pressure control region changes from the region E to the region D. At that time, however, the adjustment units are already in the low combustion state. Therefore, the respective boiler units #2 and #1 in the low combustion state L remain as they are.

(7) When the vapor pressure further decreases and comes to the second critical value 7.4 kg/cm$^2$ at, for instance, the time t12 illustrated in the Figure, the pressure control region shifts from the region C to the region B. At this time, since the vapor pressure is dropping down, the boiler unit #1 of the adjustment units #2 and #1 which takes precedence over the boiler unit #2 at that time shifts from the low combustion state L to the high combustion state H, resulting in an increment in capability of evaporation of the boiler unit #1. This makes the vapor pressure turn to increase again at around the time t12. When the vapor pressure reaches the third critical value 7.8 kg/cm$^2$ again at, e.g., the time t13 shown in the Figure, the pressure control region changes from the region C to the region D. Because the boiler unit #2 of the adjustment units #2 and #1 has, as mentioned above, already been in the low combustion state L, the boiler unit #1 in the high combustion state H moves to the low combustion state L. As a result, the capability of evaporation of the boiler unit #1 diminishes, and the vapor pressure turns to decrease again at around the time t13. As far as the thermal load is almost constant, the adjustment unit #2 of the boiler units #1 and #2 in the combustion state is held in the low combustion state L and the other adjustment unit #2 repeatedly shifts between the low combustion state L and the high combustion state H, as in the above-described manner. Hence, the vapor pressure, as illustrated in the Figure, fluctuates between the second critical value 7.4 kg/cm$^2$ and the third critical value 7.8 kg/cm$^2$ (t11—t12—t13—t14—t15), with the result that the vapor pressure converges in the state holding region C.

In a case where unlike the situation at the time t10, the vapor pressure does not change its trend from rise to fall and still continues to increase, even after the control region shifts, as described above, from the control region D to the control region E, i.e., from the low combustion state shifting mode to the combustion unit number decrease mode, the combustion stopping signal BD is output from the combustion unit number setting section 17 to the boiler units #1 and #2 in the combustion state, at the time when the vapor pressure reaches a predetermined maximum critical value, for example, 8.5 kg/cm$^2$. This ensures the combustion of these boiler units to be stopped. Such a function can easily be achieved by modifying some portion of the construction depicted in FIG. 2.

The above-described control operation is based on the assumption that the thermal load on the boiler system concerned is substantially constant. Next, a control operation when sharp fluctuations take place in the thermal load will be explained also with reference to FIGS. 2 and 4. If the thermal load exerted on the boiler system sharply fluctuates, the vapor pressure sharply rises or falls. Now, it is assumed that the thermal load on the boiler system sharply increases, making the vapor pressure in the steam header 11 (FIG. 1) abruptly go down, when the boiler unit #1 shifts from the high combustion state to the low combustion state L at, for instance, the time t15 and the vapor pressure is falling.

(8) When the vapor pressure reaches the second critical value 7.4 kg/cm$^2$ at, for example, the time t16, the pressure control region changes from the region C to the region B. Since the vapor pressure is falling, the boiler unit #1 of the adjustment units #2 and #1 at that time which precedes in the starting order shifts from the low combustion state L to the high combustion state H. Accordingly, the capability of evaporation of the boiler unit #1 increases, but the vapor pressure still continues to fall. Then, at the time t17 3 sec after the time t16, the high combustion state selecting signal BH is output from the combustion state selecting section 18 and is supplied to another adjustment unit at that time, viz., the boiler unit #2, which in turn shifts from the low combustion state L to the high combustion state H. If the vapor pressure further drops down and reaches the first critical value 7.2 kg/cm$^2$ at, e.g., the time t18 shown in the Figure in spite of the fact that the boiler units #1 and #2 have come to the high combustion state, the pressure control region changes from the region B to the region A, and the combustion starting signal BI is output from the combustion unit number setting section 17 and is supplied to the boiler unit #3 which precedes in the starting order among the boiler units #3 and #4 that are not in operation at that time. Then, the boiler unit #3 is started in the high combustion state H after a slight time lag. However, if the vapor pressure still remains at a level lower than the first critical value 7.4 kg/cm$^2$ even at the time t19 10 sec after the time t18, the combustion starting signal BI is output from the combustion unit number setting section 17 and is supplied to the last boiler unit #4 at the time t19, making this unit #4 start in the high combustion state H. As a result, the vapor pressure turns to rise and goes on rising to cause the control region to shift from the region A to the region B (at the time t20), from the region B to the region C (at the time t21) and finally to the region D (at the time t22). Thus the vapor pressure converges in the control region C, taking almost the same course as that in the above-stated case (from the time t10 to the time t15).

(9) Next, a case where the vapor pressure sharply increases due to a drop in thermal load will be explained. It is assumed that when the boiler unit #1 moves from the low combustion state L to the high combustion state H at, e.g., the time t14 and the vapor pressure is increasing, the vapor pressure, as indicated by a broken line on a vapor pressure curve of FIG. 4, sharply rises and reaches the third critical value 7.8 kg/cm$^2$ at, e.g., the time t24 shown in the Figure. At this time, the pressure control region changes from the region C to the region D, viz., to the low combustion state shifting mode. In this low combustion state shifting mode, unlike the case already mentioned in the items (4) to (7) in connection with the time t6 to the time t12, the boiler unit #3 and #4 are not in operation. The boiler unit #1 is in the high combustion state H, whereas the boiler unit #2 is in the low combustion state L. Hence, the boiler unit #1 moves from the high combustion state H to the low combustion state L at the time t24. If the vapor pressure still continues to increase and enters the control region E at, for example, the time t25 shown in the Figure, the boiler unit #2 in the low combustion state ceases combustion in response to the combustion stopping signal BD transmitted from the combustion unit number setting section 17. A difference between the number of units which is set by the adjustment unit number setting switch 22 and the number of units which are actually being operated is produced when the combustion of the boiler unit #2 stops. In consequence, the AND gate 19 is supplied with the adjustment unit number increase request signal Bp from the adjustment unit number setting section 21. At this time, the vapor pressure goes on rising, and the low combustion state request signal BL is also input to the AND gate 19. Then, the AND gate 19 outputs a high level signal. However, there is no boiler unit which is being operated in the high combustion state at that time, with the result that the output signal from the AND gate 19 is ignored.

If the vapor pressure does not go out of the control region E at the time t26 3 sec after the time t25, the boiler unit #1 in the low combustion state similarly ceases combustion in response to the signal BD sent from the combustion unit number setting section 17, with the result that the entire boiler system stops its operation to cope with such an abnormal drop in load. Where the vapor pressure turns to decrease in the control region E after the time t25, the boiler unit #1 which is solely in operation has already been in the low combustion state L, and thus keeps its state. This boiler unit continues to hold this state even after entering the control region C. After that the vapor pressure converges to a region in the control region C, taking the course mentioned in the items (6) and (7) in regard to, for example, the time t11 to the time t14.

The embodiment of the present invention has been described above. Additions or modifications may, as a matter of course, be effected to the embodiment of the apparatus for controlling the boiler system according to the present invention. For instance, in the above-described embodiment, it is feasible to arbitrarily modify the reference voltage values respectively set in the comparators 15*a* through 15*d* in the hardware construction depicted in FIG. 2 in correspondence with the critical values of the vapor pressures between the vapor pressure control regions A, B, C, D and E. The hardware construction of FIG. 3, in particular the construction of the adjustment unit number setting section 21 may be replaced by other suitable circuit constitutions or computer programs. Besides, the order in which the boiler units are started is the same as the order in which the units are arranged in the embodiment described above. However, the starting order of the respective boiler units may arbitrarily be set regardless of the arranging order thereof.

Industrial Applicability

As discussed above, the present invention provides such an effect that the output of the entire boiler system smoothly converges in a desired range by minimizing the frequency at which the respective boiler units are repeatedly stopped and started. The present invention is effective in controlling a boiler system including a plurality of boiler units.

I claim:

1. An apparatus for controlling a boiler system, comprising:

a plurality of boiler units (10) connected in common to a steam header (11) and shiftable between the halting state and the operating state in response to each of a combustion starting signal (BI) and a combustion stopping signal (BD) and further shiftable in said operating state between a high combustion state and a low combustion state in response to each of a high combustion state selecting signal (BH) and a low combustion state selecting signal (BL);

a pressure adjuster (12) connected to said steam header (11) for outputting a vapor pressure signal (P) indicating the vapor pressure in said header (11); and a control unit (13) for controlling each of said plurality of boiler units (10) such that these boiler units takes one of three states in response to said vapor pressure signal (P) transmitted from said pressure adjuster (12), said control unit (13) including:

combustion unit number increase request signal generating means (15*a*) for outputting a combustion unit number increase request signal (Bi) by detecting the fact that said vapor pressure indicated by said vapor pressure signal (P) is equal to or smaller than a first critical value;

high combustion state request signal generating means (15*b*) for outputting a high combustion state request signal (Bh) by detecting the fact that said vapor pressure indicated by said vapor pressure signal (P) is equal to or smaller than a second critical value greater than said first critical value;

low combustion state request signal generating means (15*c*) for outputting a low combustion state request signal (Bl) by detecting the fact that said vapor pressure indicated by said vapor pressure signal (P) is equal to or larger than a third critical value greater than said second critical value;

combustion unit number decrease request signal generating means (15*d*) for outputting a combustion unit number decrease request signal (Bd) by detecting the fact that said vapor pressure indicated by said vapor pressure signal (P) is equal to or larger than a fourth critical value greater than said third critical value;

combustion unit number setting means (17) for sequentially supplying each of said plurality of boiler units (10) with said combustion starting signal (BI) in response to said combustion unit number increase request signal (Bi) according to the order of starting said boiler units every time a predetermined time passes, and for sequentially supplying each of said plurality of boiler units with said combustion stopping signal (BD) in response to said combustion unit decrease request signal (Bd) in the order reverse to said starting order every time a predetermined time passes;

combustion state selecting means (18) for sequentially supplying each of said plurality of boiler units (10) with a high combustion state selecting signal (BH) in response to said high combustion state request signal (Bh) in the order of starting said boiler units every time a predetermined time passes, and for sequentially supplying each of said plurality of boiler units (10) with a low combustion state selecting signal (BL) in response to said low combustion state request signal (Bl) in the order reverse to the starting order every time a predetermined time passes;

adjustment unit number setting means (21) for outputting an adjustment unit number increase signal (Bp) by deciding that the number of said boiler units operating in the low combustion state is smaller than the number of adjustment units on the basis of said combustion starting signal (BI) supplied from said combustion unit number setting means (17) to each of said plurality of boiler units (10), said low combustion state selecting signal (BL) supplied from said combustion state selecting means (18) to each of said plurality of boiler units (10) and an adjustment unit number setting signal indicating the number of said adjustment units; and low combustion state request signal supplying means (19) for allowing said combustion state selecting means (18) to supply said low combustion state request signal (Bl) in response to said adjustment unit number increase signal (Bp).

* * * * *